US005311855A

United States Patent [19]

Basik

[11] Patent Number: 5,311,855

[45] Date of Patent: May 17, 1994

[54] BOW LAUNCHER AND ARROW SYSTEM

[76] Inventor: Ronald Basik, 4521 N. Kimball, Chicago, Ill. 60625

[21] Appl. No.: 924,132

[22] Filed: Aug. 3, 1992

Related U.S. Application Data

[63] Continuation-in-part of Ser. No. 749,917, Aug. 26, 1991, abandoned.

[51] Int. Cl.[5] ..... F41B 5/00

[52] U.S. Cl. ..... 124/44.5; 124/41.1; 124/26; 124/24.1; 273/420; 273/423

[58] Field of Search ..... 124/44.5, 41.1, 24.1, 124/26, 88, 86; 273/416, 420, 423

[56] References Cited

U.S. PATENT DOCUMENTS

| | | | |
|---|---|---|---|
| 2,887,319 | 5/1959 | Lay | 273/423 |
| 3,406,676 | 10/1968 | Dye | 124/44.5 |
| 3,614,947 | 10/1971 | Feldman | 124/86 |
| 4,111,424 | 9/1978 | Schreiber | 273/416 |
| 4,204,307 | 5/1980 | Pfetzing | 273/423 |
| 4,318,390 | 3/1982 | Trotter | 124/44.5 |
| 4,827,895 | 5/1989 | Troncoso | 124/44.5 |
| 4,858,588 | 8/1989 | Bozek | 273/416 |
| 4,946,172 | 8/1990 | Wong | 273/420 |
| 5,067,728 | 11/1991 | Dadbeh | 273/420 |
| 5,070,855 | 12/1991 | Troncoso | 124/44.5 |

FOREIGN PATENT DOCUMENTS

| | | | |
|---|---|---|---|
| 620536 | 3/1949 | United Kingdom | 273/423 |

*Primary Examiner*—Randolph A. Reese
*Assistant Examiner*—Anthony Knight
*Attorney, Agent, or Firm*—Wood, Phillips, Van Santen, Hoffman & Ertel

[57] ABSTRACT

In order to provide enhanced performance from fletching, a stabilizer is operatively associated with an arrow shaft to be moveable from a launch position near the tip of an arrow at one end thereof to a flight position near the nock of the arrow at the other end thereof. The stabilizer includes a slide collar disposed on the shaft for sliding movement therealong and having a plurality of radial vanes each with a leading edge and a trailing edge as well as a reinforcing extension forwardly of the leading edges of the vanes and extending rearwardly at least to the trailing edges thereof. By limiting the stabilizer to sliding movement along the shaft from the launch position to the flight position, a bow having a riser may be provided with a launcher mounted on the riser to resiliently grip the stabilizer with the vanes forward of the riser during launch.

29 Claims, 4 Drawing Sheets

BOW LAUNCHER AND ARROW SYSTEM

RELATED APPLICATION

This application is a continuation-in-part of earlier co-pending application U.S. Ser. No. 749,917, filed Aug. 26, 1991, of Ronald Basik for "Bow Launcher and Arrow System," now abandoned.

FIELD OF THE INVENTION

The present invention is generally directed to a bow having a riser and an arrow having a shaft and, more particularly, a launcher associated with the riser and a slide shaft stabilizer associated with the shaft.

BACKGROUND OF THE INVENTION

In the past, it has been known to utilize feathers for fletching arrows. This has usually required fabricating techniques which are time consuming inasmuch as feathers typically required multiple hand operations including trimming to size, aligning and fastening to the shaft of an arrow. As is known, arrow fletching by this process is a labor intensive, expensive proposition.

In another respect, there has been no practical manner for repairing arrows with damaged fletching. The fact is that it is difficult, if not impossible, to find anyone with the apparatus and/or expertise to refletch arrows at a reasonable price. As a result, many arrows with damaged fletches must simply be discarded by archers.

In order to remedy these deficiencies, it has been proposed to utilize plastic unitary fletching in U.S. Pat. No. 2,887,319. This involves the concept of having vanes connected to a cylindrical body which slips over the arrow shaft, but with a tight fit so the fletching stays in place after it is initially positioned. With this approach, it has been found that the fletching can be damaged due to its light weight as it is pulled onto the shaft.

In an attempt to successfully overcome the problems in U.S. Pat. No. 2,887,319, it has been proposed to provide the fletching with two annular forms. These annular forms are utilized as gripping means, as disclosed in U.S. Pat. No. 4,204,307, for pulling the fletching onto the arrow shaft following which they are removed once the fletching is in place. Alternatively, this patent proposes that the fletching be molded directly onto the arrow shaft in connection with OEM production.

Still additional prior art dealing with arrows in general, and fletching in particular, include the disclosures in British Patent 620,536 and U.S. Pat. Nos. 3,614,947; 4,111,424; and 4,858,588.

Despite these various attempts to advance the art, there has been a continuing need for still further improvements. It would be desirable, for instance, to be able to injection mold fletching in the form of a slidable stabilizer which would be capable of avoiding bending even in the presence of launch forces and/or cross winds while accommodating exact pitch and indexing from one stabilizer to the next to provide greater accuracy along with an increased effective kill range. Also, there would be a significant advantage to maintaining the fletching forwardly of the riser of a bow during launch so as to avoid interference with launch and/or damage to the fletching. It would also be desirable to provide a stabilizer which can be stored and transported without damaging the vanes where the vanes would be capable of retarding blow through while allowing any shaft to be quickly retrofitted in the field. Still additionally, the art would benefit from a launcher that would permit the bow to be rotated to any position during launch while continuing to grip the arrow.

In addition, the art would benefit if fletching could temporarily be removed for the purpose of checking arrow shafts for straightness by any means such as rolling the arrow shaft on a flat surface. Still further, the art would benefit if the fletching could be provided in a number of different design configurations and could be used with most compound bows, recurve bows, and cross bows.

As for other attributes of importance, the fletching should be capable of withstanding the forces that are typically encountered. It should also be the case that the fletching stays in place throughout flight and after target impact, and it should be such as to eliminate the need for glue and fletching jigs. Finally, the fletching should reduce arrow manufacturing time and expense and, ideally, provide for a more balanced flight.

The present invention is directed to overcoming the foregoing problems and achieving the recited objectives.

SUMMARY OF THE INVENTION

It is a principal object of the invention to provide a slide shaft stabilizer moveable from a launch position to a flight position. It is a further object of the invention to provide a slide shaft stabilizer moveable from near the tip to near the nock of the arrow. It is a still further object of the invention to provide launching means mounted on the riser of a bow. It is a still additional object of the invention to provide resilient gripping means for gripping the slide shaft stabilizer during launch.

Accordingly, the present invention is directed to an arrow having a shaft with a tip at one end thereof and a nock at the other end thereof together with stabilizer means moveable from a launch position near the tip to a flight position near the nock. The stabilizer means includes a slide collar disposed on the shaft for sliding movement therealong together with a plurality of radial vanes each have a leading edge and a trailing edge. The slide collar has a reinforcing extension forwardly of the leading edges of the vanes, and it extends rearwardly of the reinforcing extension at least to the trailing edge thereof. Still additionally, the arrow includes means near the tip and the nock for engaging the slide collar to limit the stabilizer means to movement along the shaft between the launch position and the flight position.

In a preferred embodiment, the slide collar has an inner diameter substantially the same as an outer diameter of the shaft from the reinforcing extension to at least the trailing edges of the vanes. Also, the slide collar also has an inner diameter larger than the outer diameter of the shaft remote from the reinforcing extension and facing rearwardly of the trailing edges of the vanes.

Further, in the preferred embodiment, the slide collar has a substantially uniform outer diameter from the reinforcing extension to at least a point forwardly of but near the trailing edges of the vanes. Also, the slide collar tapers conically outward from that point to a rearward extension of substantially uniform diameter rearwardly of but near the trailing edges of the vanes.

In other respects the limit means near the nock preferably comprises at least one rearward retainer on the shaft forwardly of the nock and having an outer diameter larger than the inner diameter of the reinforcing extension. The rearward retainer advantageously comprises a resilient band and/or a plurality of resilient rings having an outer diameter substantially the same as the inner diameter of the slide collar facing rearwardly of the trailing edges of the vanes. The arrow may also suitably include indicia on the shaft for selecting a position of adjustment for the resilient band or the rearwardmost of the resilient rings prior to launching the arrow to cause the stabilizer means to move from the launch position to the flight position. The resilient band and/or the plurality of resilient rings is advantageously dimensioned for gripping the shaft at any selected position of adjustment with sufficient force to stop the stabilizer means during movement from the launch position to the flight position. Still further, the limit means near the tip preferably includes a forward retainer between the tip and the shaft having an outer diameter larger than an inner diameter of the reinforcing extension.

In another respect, the present invention is directed to the combination of a bow having a riser and an arrow having a shaft including stabilizer means thereon as previously discussed hereinabove. This combination also includes launching means mounted on the riser of the bow which has resilient gripping means associated therewith. With this arrangement, the resilient gripping means grips a rearwardly extending portion of the slide collar when the arrow is placed in the launching means for launching the arrow from the bow.

In still another respect, the present invention is directed to a launcher for an arrow comprising a base adapted to be mounted on a riser of a bow and resilient gripping means supported by a stand-off in spaced relation to the base. The base is adapted to extend rearwardly of the bow to position the resilient gripping means rearwardly of the riser of the bow. With these basic features of construction, the resilient gripping means is adapted to grip the arrow so as to isolate the arrow from contact with the base or the riser.

Further, the base preferably includes means for adjusting the mounting position of the launcher relative to the riser. The resilient gripping means advantageously includes an arrow shaft receiving channel dimensioned larger than the diameter of a shaft of the arrow. Still additionally, the resilient gripping means preferably has a pair of inwardly tapering forwardly extending resilient fingers for gripping the arrow.

In a highly preferred embodiment, the radial vanes extend generally axially relative to the shaft and the slide collar, and they are circumferentially indexed in equally spaced relation about the slide collar.

Other objects, advantages and features of the present invention will become apparent from a consideration of the following specification taken in conjunction with the accompanying drawings.

DETAILED DESCRIPTION OF THE PREFERRED EMBODIMENTS

Figure 2:
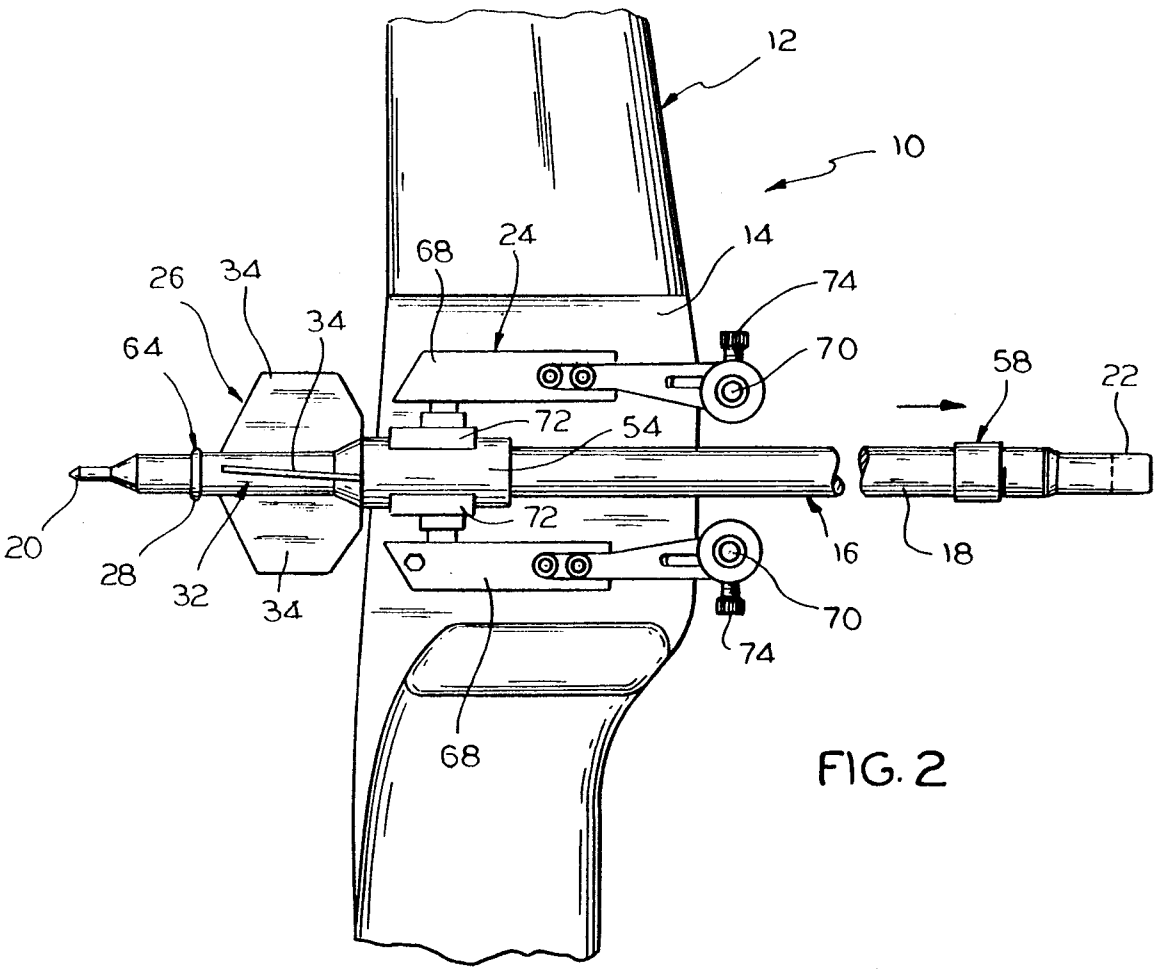
FIG. 2 is an enlarged side elevational view of the stabilizer means and launching means of the bow and arrow illustrated in FIG. 1.
Figure 1:
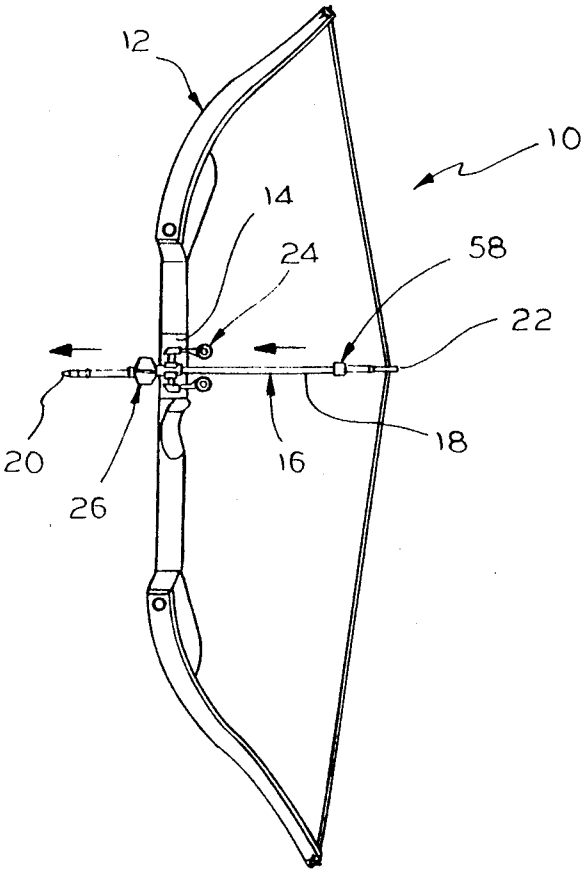
FIG. 1 is a side elevational view of a bow having a riser and an arrow having a shaft in accordance with the present invention.

In the illustrated embodiment, and with reference first to FIG. 1, the reference numeral 10 designates generally a bow and arrow in accordance with the present invention. The bow and arrow 10 includes a bow 12 having a riser 14 and an arrow 16 having a shaft 18 with a tip 20 at one end thereof and a nock 22 at the other end thereof (see, also, FIG. 2). As best shown in FIG. 2, the bow and arrow 10 further includes launching means 24 which is mounted on the riser 14 and stabilizer means 26 which is mounted on the arrow 16. mounted on the riser 14 and stabilizer means 26 which is mounted on the arrow 16.

Figure 4:
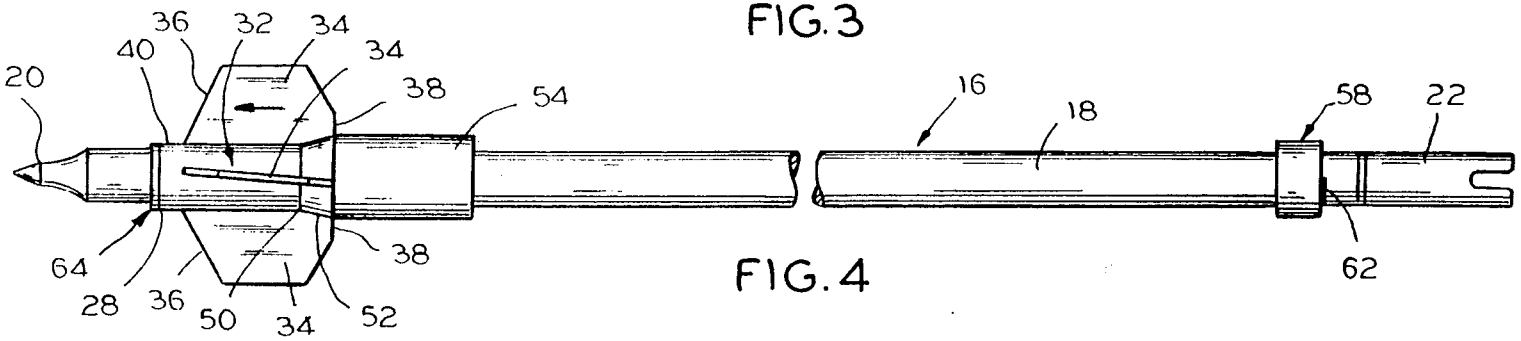
FIG. 4 is a side elevational view, partially broken away, illustrating the stabilizer means in a launch position.
Figure 5:
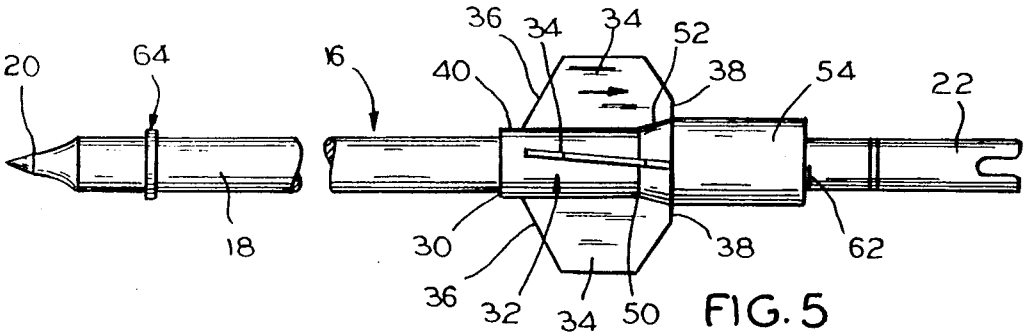
FIG. 5 is a side elevational view, partially broken away, illustrating the stabilizer means in a flight position.

Comparing FIGS. 4 and 5, the stabilizer means 26 is moveable from a launch position as at 28 near the tip 20 of the arrow 16 to a flight position 30 near the nock 22 of the arrow 16. The stabilizer means 26 includes a slide collar 32 disposed on the shaft 18 for sliding movement therealong and it has a plurality of radial vanes 34 each having a leading edge 36 and a trailing edge 38. As shown, the slide collar 32 has a reinforcing extension 40 forwardly of the leading edges 36 of the vanes 34 and extends rearwardly at least to the trailing edges 38 thereof.

Figure 3:
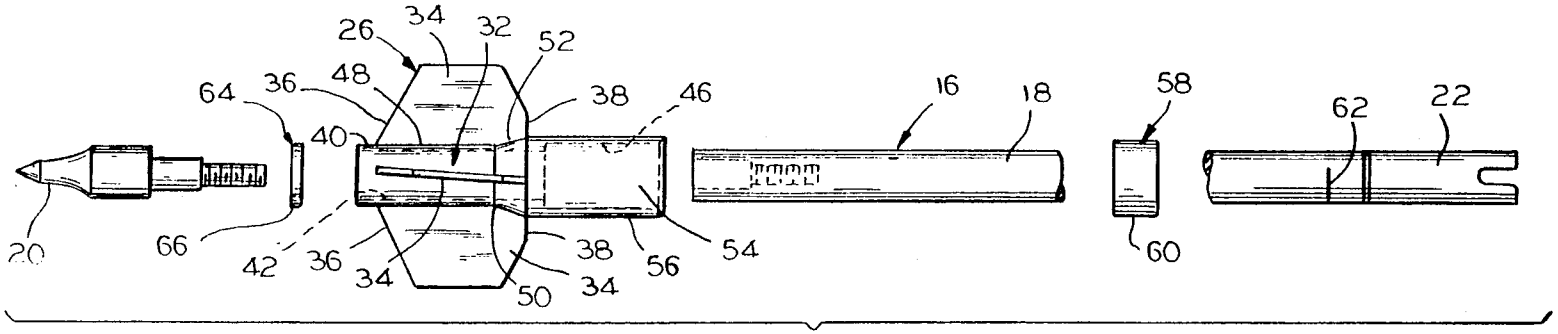
FIG. 3 is an exploded side elevational view of all of the various components which comprise the arrow illustrated in FIG. 1.

As best shown in FIG. 3, the slide collar 32 has an inner diameter as at 42 substantially the same as an outer diameter as at 44 of the shaft 18 from the reinforcing extension 40 to at least the trailing edges 38 of the vanes 34. It also has an inner diameter as at 46 larger than the outer diameter as at 44 of the shaft 18 remote from the reinforcing extension 40 and facing rearwardly of the trailing edges 38 of the vanes 34. Still referring to FIG. 3, the slide collar 32 has a substantially uniform outer diameter as at 48 from the reinforcing extension 40 to at least a point such as 50 forwardly of but near the trailing edges 38 of the vanes 34. It then tapers conically outward as at 52 from point 5 to a rearward extension 54 of substantially uniform diameter as at 56 rearwardly of but near the trailing edges 38 of the vanes 34. As shown in FIGS. 3, 4 and 5, the arrow 16 includes means near the tip 20 and the nock 22, respectively, for engaging the slide collar 32 to limit the stabilizer means 26 to sliding movement along the shaft 18 from the launch position as at 28 to the flight position as at 30.

Referring now to FIGS. 3 and 5, the limit means near the nock 22 includes at least one rearward retainer 58 on the shaft 18 forwardly of the nock 22 having an outer diameter as at 60 larger than the inner diameter as at 42 of the reinforcing extension 40. The rearward retainer 58 comprises a resilient band having its outer diameter as at 60 substantially the same as the inner diameter as at 46 of the slide collar 32 facing rearwardly of the trailing edges 38 of the vanes 34, i.e., the outer diameter as at 60 is substantially the same as the inner diameter as at 46 of the rearward extension 54. The arrow 16 may advantageously include indicia as at 62 for selecting a position of adjustment for the resilient band 58 prior to launching the arrow 16 to cause the stabilizer means 26 to move from the launch position as at 28 to the flight position as at 30. The resilient band 58 is dimensioned for gripping the shaft 18 at any selected position of adjustment such as 62 with sufficient force to stop the stabilizer means 26 during movement from the launch position 28 to the flight position 30, i.e., the resilient band 58 slips within the rearward extension 54 where it stops the movement of the stabilizer means 26. Still additionally, the limit means near the tip 20 includes a forward retainer 64 preferably disposed between the tip 20 and the shaft 18 and having an outer diameter as at 66 larger than the inner diameter as at 42 of the reinforcing extension 40.

Figure 7:
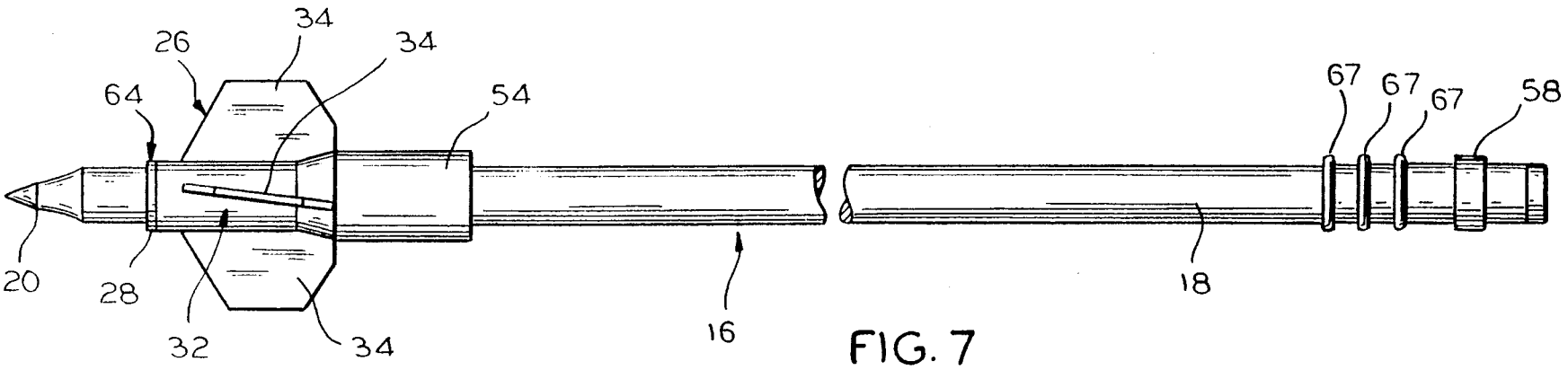
FIG. 7 is a side elevational view, partially broken away, illustrating another embodiment of the present invention.

In one alternative embodiment illustrated in FIG. 7, the rearward retainer further comprises a plurality of axially spaced resilient rings 67. It will be observed that these rings 67 are not only axially spaced but are also positioned forwardly of the resilient band 58 to decelerate and/or stop the movement of the stabilizer means 26 so as to ensure that the stabilizer means 26 will at least be stopped by the resilient band 58 by the time it reaches what has hereinabove been referred to as the flight position. For this purpose, the resilient rings 67 preferably also have substantially the same inner and outer diameters as the resilient band 58.

Figure 8:
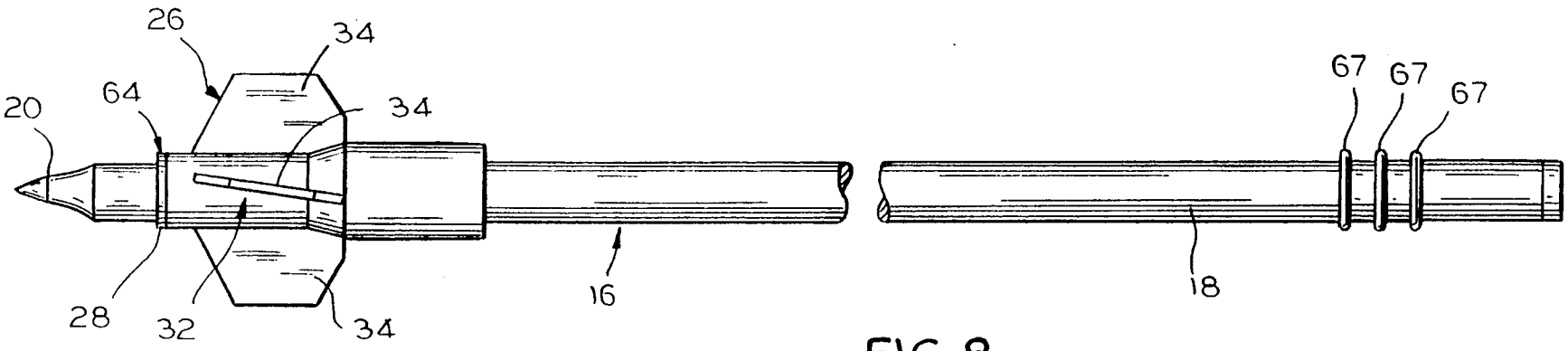
FIG. 8 is a side elevational view, partially broken away, illustrating still another embodiment of the present invention.

Referring to FIG. 8, it will be noted that the resilient band 58 has been eliminated since it may be sufficient and/or desirable to only use three axially spaced resilient rings 67 which are dimensioned for gripping the shaft 18. In particular, they preferably grip with sufficient force to stop the stabilizer means 26 during movement from the launch position 28 to the flight position 30. In this connection, the resilient rings 67 will be dimensioned so as to slip within the rearward extension 54 where they will stop the movement of the stabilizer means 26 in the selected position, e.g., the flight position 30 (see FIG. 5).

From the above, it will be appreciated that the limit means near the nock 22 can include a plurality of rearward retainers 58 and/or 67 on the shaft 18 forwardly of the nock 22 each having an outer diameter larger than an inner diameter of the reinforcing extension 40. Specifically, the rearward retainers may include the resilient band 58 and/or three axially spaced resilient rings 67 each having an outer diameter substantially the same as the inner diameter of the rearward extension 54 of the slide collar 32.

Referring once again to FIGS. 1 and 2, the launching means 24 mounted on the riser 14 of the bow 12 has resilient gripping means in the form of fingers 68. Either or both of the fingers 68 may be spring biased for pivoting movement toward the arrow 16 when it is in the riser 14 about the pivot axis 70, and they both may include gripping pads as at 72 for gripping the rearward extension 54 of the slide collar 32 substantially as shown in FIG. 2. In addition, the launching means 24 may include adjustment screws 74 for adjusting the tension of the springs in any well known manner.

As will be appreciated, the details of the launching means 24 are subject to variation. It is contemplated, however, that one of the fingers 68 may be fixedly mounted while the other finger 68 may include a suitable spring mechanism for pivotal movement about its axis 70 along with spring tension or force adjustment means such as 74. In any event, the details of the mechanism are well within the abilities of those skilled in the art.

With the arrangement illustrated in FIGS. 1 and 2, the stabilizer means 26 is held with the vanes 34 forward of the riser 14 in the launch position as at 28. Thus, the vanes 34 do not pass the surface of the riser 14 or, for that matter, the gripping surfaces 72 of the fingers 68 and are thus not subject to damage during launch. Still additionally, it will be appreciated that the fact fletching need not pass the surface of the riser 14 will result in greater shooting accuracy.

In this connection, conventional fletching will make contact with the surface of the riser 14 during the launch of an arrow. This can cause the arrow to be diverted from the intended path thus greatly diminishing accuracy. With the present invention, the stabilizer means 26 is positioned forwardly of the riser 14 so that this cannot possibly occur.

Figure 10:
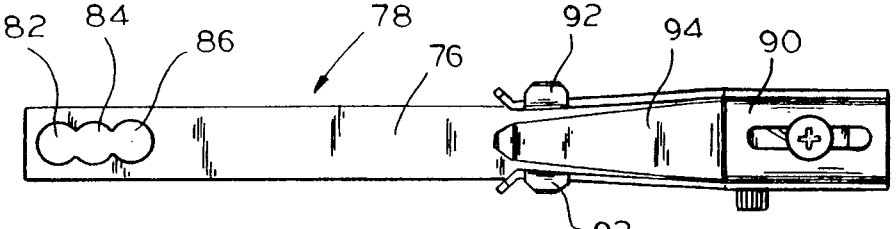
FIG. 10 is a side elevational view of the launcher for an arrow as illustrated in FIG. 9.
Figure 9:
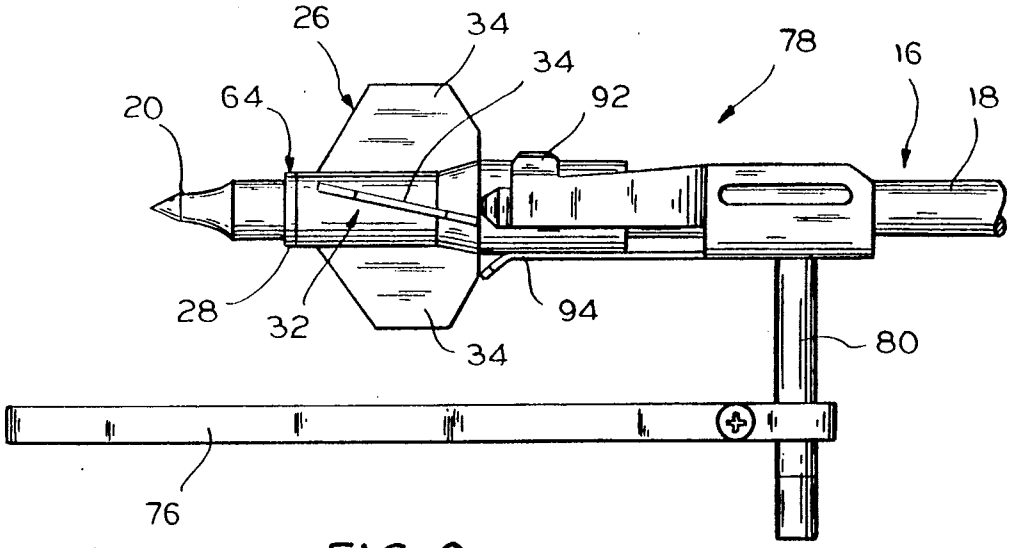
FIG. 9 is an enlarged bottom view of a launcher for an arrow in accordance with the present invention.
Figure 11:
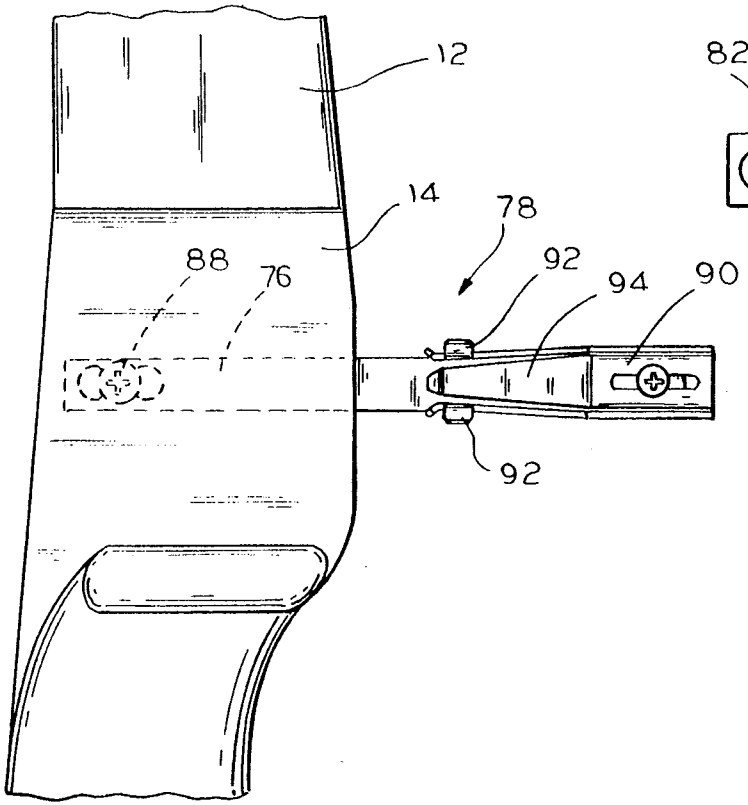
FIG. 11 is an enlarged side elevational view of a bow having a launcher such as that illustrated in FIGS. 9 and 10.

Referring to FIGS. 9 through 11, an alternative embodiment of launcher 24' includes a base 76 adapted to be mounted on a riser 14 of a bow 12 and resilient gripping means generally designated 78 which is supported by a stand-off 80 in spaced relation to the base 76. It will be appreciated that the base 76 is adapted to extend rearwardly of the bow 12 to position the resilient gripping means generally designated 78 rearwardly of the riser 14 of the bow 12. With this understanding of the alternative embodiment of launcher 24', the resilient gripping means generally designated 78 is adapted to grip an arrow in such manner as to isolate it from contact with the base 76 or the riser 14.

As best shown in FIGS. 10 and 11, the base 76 includes means for adjusting the mounting position of the launcher 24' relative to the riser 14 which may take the form of a plurality of interconnected or separated holes 82, 84, 86, etc. A screw 88 may pass through the desired one of the holes 82, 84, 86, etc. substantially as shown in FIG. 11, and the resilient gripping means generally designated 24' preferably includes an arrow shaft receiving channel 90 dimensioned larger than the diameter of the shaft 18 of the arrow 16. When the launcher 24' is so formed, the resilient gripping means generally designated 24' preferably has a pair of what will be understood to comprise inwardly tapering forwardly extending resilient fingers 92 for gripping the arrow 16.

As shown in FIG. 9, the fingers 92 may be utilized to grip the rearward extension 54 of the slide collar 32. It will be noted in this regard that the arrow shaft receiving channel 90 is preferably further defined by what will be understood to comprise a forwardly extending support finger 94. By forming the fingers 92 and 94 of spring steel, they will retain their resiliency while exhibiting the desired gripping characteristics.

Figure 6:
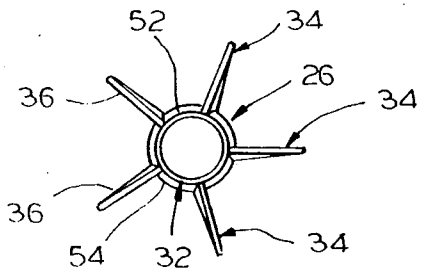
FIG. 6 is a rear elevational view of the stabilizer means illustrated in FIGS. 3 through 5.

As will be appreciated by comparing FIGS. 5 and 6, the radial vanes 34 extend generally axially relative to the shaft 18. There may, if desired, be a slight angle between the plane of the vanes 34 and the axis of the shaft 18 in order to impart roll to the arrow 16 during flight and, of course, this will occur due to the fact that the resilient band 58 will firmly grip not only the shaft 18 of the arrow 16 but also the inner surface of the rearward extension 54 of the slide collar 32 so as to prohibit relative movement therebetween. As shown in FIG. 6, the radial vanes 34 also are circumferentially indexed in equally spaced relation about the slide collar 32.

In accordance with the present invention, the stabilizer means 26 is well suited for manufacture by conventional injection molding techniques. The forward retainer 64 can also be formed of a plastic material in which case the tip 20 may simply be unthreaded from the shaft 18 of the arrow 16, the stabilizer means 26 slidable inserted onto the shaft 18, and the tip 20 rethreaded into the shaft 18 with the forward retainer 64 disposed therebetween. Of course, the resilient band 58 may simply be moved onto the shaft 18 by stretching over the nock 22 and the shaft 18 until it is in a selected position such as 62.

From the foregoing, it will be appreciated that the archer may simply purchase a supply of conventional arrows 16 consisting of a shaft 18, a tip 20, and a nock 22. The arrows may each quickly be outfitted with a stabilizer means 26, resilient band 58, and forward retainer 64 as previously described, either at home or in the field, for immediate use of the arrow 16. In addition the arrows 16 may rapidly be repaired by simply carrying replacement parts in the form of the stabilizer means 26, resilient band 58, and forward retainer 64.

In practice, the resilient band 58 may be formed of a latex material and the stabilizer means 26 may be formed of a material such as that sold under the trademark Delrin. These materials cooperate to provide a very limited amount of slippage when compression of the resilient band 58 takes place during launch, and the stabilizer means 26 is subsequently disengaged from the resilient band 58 easily and effectively. Still additionally, the materials mentioned have excellent thermal expansion characteristics which serves to make them ideal for all weather conditions.

It should now be appreciated the present invention has achieved all of the objectives mentioned hereinabove. It is believed that the bow and arrow combination as well as the unique aspects of the arrow itself represent a significant advancement in the art. As such the present invention overcomes the various problems that have previously been encountered by archers as discussed hereinabove.

While in the foregoing there has been set forth a preferred embodiment of the invention, it will be appreciated that the details herein given may be varied by those skilled in the art, without in any way departing from the true spirit and scope of the appended claims.

I claim:

1. In an arrow having a shaft with a tip at one end thereof and a nock at the other end thereof, the improvement comprising:

stabilizer means movable from a launch position near said tip to a flight position near said nock, said stabilizer means including a slide collar disposed on said shaft for sliding movement therealong, said slide collar having a plurality of radial vanes each having a leading edge and a trailing edge;

said slide collar extending forwardly of said leading edges of said vanes, said forward extension of said slide collar providing reinforcement for withstanding forces encountered in use of said stabilizer means with said arrow, said slide collar also extending rearwardly at least to said trailing edges of said vanes; and means near said tip and said nock for engaging said slide collar to limit said stabilizer means to movement along said shaft from said launch position to said flight position.

2. The arrow of claim 1 wherein said slide collar has an inner diameter substantially the same as an outer diameter of said shaft from said forward reinforcing extension to at least said trailing edges of said vanes.

3. The arrow of claim 2 wherein said slide collar has an inner diameter larger than said outer diameter of said shaft remote from said forward reinforcing extension facing rearwardly of said trailing edges of said vanes.

4. The arrow of claim 1 wherein said slide collar has a substantially uniform outer diameter from said forward reinforcing extension to at least a point forwardly of but near said trailing edges of said vanes.

5. The arrow of claim 4 wherein said slide collar tapers conically outward from said point to a rearward extension of substantially uniform diameter rearwardly of but near said trailing edges of said vanes.

6. The arrow of claim 1 wherein said limit means near said tip includes a retainer between said tip and said shaft and having an outer diameter larger than an inner diameter of said forward reinforcing extension.

7. The arrow of claim 1 wherein said limit means near said nock includes at least one retainer on said shaft forwardly of said nock and having an outer diameter larger than an inner diameter of said forward reinforcing extension.

8. In an arrow having a shaft with a tip at one end thereof and a nock at the other end thereof, the improvement comprising:

stabilizer means movable from a launch position near said tip to a flight position near said nock, said stabilizer means including a slide collar disposed on said shaft for sliding movement therealong, said slide collar having a plurality of radial vanes each having a leading edge and a trailing edge;

said slide collar extending forwardly of said leading edges of said vanes, said forward extension of said slide collar providing reinforcement for withstanding forces encountered in use of said stabilizer means with said arrow, said slide collar also extending rearwardly at least to said trailing edges of said vanes;

said slide collar having an inner diameter substantially the same as an outer diameter of said shaft from said forward reinforcing extension to at least said trailing edges of said vanes and having an inner diameter larger than said outer diameter of said shaft remote from said forward reinforcing extension and facing rearwardly of said railing edges of said vanes, said slide collar having a substantially uniform outer diameter from said forward reinforcing extension to at least a point forwardly of but near said trailing edges of said vanes and tapering conically outward from said point to a rearward extension of substantially uniform diameter rearwardly of but near said trailing edges of said vanes; and means near said tip and said nock for engaging said slide collar to limit said stabilizer means to movement along said shaft from said launch position to said flight position.

9. The arrow of claim 8 wherein said radial vanes extend generally axially relative to said shaft and said slide collar and are circumferentially indexed in equally spaced relation about said slide collar.

10. The arrow of claim 8 wherein said limit means near said tip includes a forward retainer between said tip and said shaft and having an outer diameter larger than an inner diameter of said forward reinforcing extension.

11. The arrow of claim 8 wherein said limit means near said nock includes at least one rearward retainer on said shaft forwardly of said nock and having an outer diameter larger than an inner diameter of said forward reinforcing extension.

12. The arrow of claim 11 wherein said rearward retainer comprises a resilient band having an outer diameter substantially the same as said inner diameter of said slide collar facing rearwardly of said trailing edges of said vanes.

13. The arrow of claim 12 including indicia on said shaft for selecting a position of adjustment for said resilient band prior to launching said arrow to cause said stabilizer means to move from said launch position to said flight position.

14. The arrow of claim 13 wherein said resilient band is dimensioned for gripping said shaft at any selected position of adjustment with sufficient force to stop said stabilizer means during movement from said launch position to said flight position.

15. The arrow of claim 11 wherein said rearward retainer comprises a plurality of axially spaced resilient rings dimensioned for gripping said shaft with sufficient force to stop said stabilizer means during movement from said launch position to said flight position.

16. The arrow of claim 12 wherein said rearward retainer further comprises a plurality of axially spaced resilient rings positioned forwardly of said resilient band and also having substantially the same inner and outer diameters as said resilient band.

17. In combination a bow having a riser and an arrow having a shaft with a tip at one end thereof and a nock at the other end thereof, the combination comprising:

launching means mounted on said riser of said bow and having resilient gripping means associated therewith;

stabilizer means mounted on said arrow and movable from a launch position near said tip to a flight position near said nock, said stabilizer means including a slide collar disposed on said shaft for sliding movement therealong, said slide collar having a plurality of radial vanes each having a leading edge and a trailing edge;

said slide collar having a reinforcing extension forwardly of said leading edges of said vanes and extending rearwardly to a point beyond said trailing edges of said vanes, said resilient gripping means gripping said rearwardly extending portion of said slide collar when said arrow is placed in said launching means for launching said arrow from said bow; and means near said tip and said nock for engaging said slide collar to limit said stabilizer means to movement along said shaft from said launch position to said flight position.

18. The bow and arrow of claim 17 wherein said slide collar has an inner diameter substantially the same as an outer diameter of said shaft from said reinforcing extension to at least said trailing edges of said vanes, said slide collar having an inner diameter larger than said outer diameter of said shaft remote from said reinforcing extension in said rearwardly extending portion facing rearwardly of said trailing edges of said vanes.

19. The bow and arrow of claim 17 wherein said slide collar has a substantially uniform outer diameter from said reinforcing extension to at least a point forwardly of but near said trailing edges of said vanes, said slide collar tapering conically outward to said rearwardly extending portion comprising a substantially uniform but larger diameter than the remainder of said slide collar forwardly thereof.

20. The bow and arrow of claim 18 wherein said limit means near said nock includes a rearward retainer on said shaft forwardly of said nock having an outer diameter larger than an inner diameter of said reinforcing extension, said rearward retainer comprising a resilient band having an outer diameter substantially the same as said inner diameter of said slide collar facing rearwardly of said trailing edges of said vanes.

21. The bow and arrow of claim 20 including indicia on said shaft for selecting a position of adjustment for said resilient band prior to launching said arrow to cause said stabilizer means to move from said launch position to said flight position, said resilient band being dimensioned for gripping said shaft at any selected position of adjustment with sufficient force to stop said stabilizer means during movement from said launch position to said flight position.

22. The bow and arrow of claim 18 wherein said limit means near said nock includes a plurality of rearward retainers on said shaft forwardly of said nock each having an outer diameter larger than an inner diameter of said reinforcing extension, said rearward retainers comprising three axially spaced resilient rings each having an outer diameter substantially the same as said inner diameter of said slide collar facing rearwardly of said trailing edges of said vanes.

23. The bow and arrow of claim 22 wherein said rearward retainers further include a resilient band axially spaced rearwardly of said resilient rings and having an inner and outer diameter substantially the same as said resilient rings.

24. The bow and arrow of claim 17 wherein said radial vanes extend generally axially relative to said shaft and said slide collar and are circumferentially indexed in equally spaced relation about said slide collar.

25. The bow and arrow of claim 17 wherein said launching means includes a base mounted on said riser and a stand-off supporting said resilient gripping means in spaced relation to said base and said riser, said base extending rearwardly of said bow to position said resilient gripping means rearwardly of said riser for gripping said rearwardly extending portion of said slide collar so as to isolate said vanes from contact with said base or said riser.

26. The bow and arrow of claim 25 wherein said base includes means for adjusting the mounting position of said launching means relative to said riser and said resilient gripping means includes a shaft receiving channel dimensioned larger than the diameter of said shaft and having a pair of inwardly tapering forwardly extending resilient fingers for gripping said rearward extension of said slide collar.

27. A kit for use with an arrow having a shaft with a tip at one end thereof and a nock at the other end thereof, comprising:

stabilizer means positionable on said shaft for movement from a launch position near said tip to a flight near said nock, said stabilizer means including a slide collar positionable on said shaft for sliding movement therealong, said slide collar having a plurality of integral radial vanes each having a leading edge and a trailing edge when said stabilizer means is positioned on said shaft;

said slide collar extending forwardly of said leading edges of said vanes, said forward extension of said slide collar providing reinforcement for withstanding forces encountered in use of said stabilizer means with said arrow, said slide collar also extending rearwardly at least to said trailing edges of said vanes; and means for positioning near said tip and near said nock for engaging said slide collar to limit said stabilizer means to movement along said shaft from said launch position to said flight position.

28. A launcher for an arrow, comprising:

a base adapted to be mounted on a riser of a bow and resilient gripping means supported by a stand-off in spaced relation to said base, said base being adapted to extend rearwardly of said bow to position said resilient gripping means rearwardly of a riser of said bow, said resilient gripping means being adapted to grip said arrow so as to isolate said arrow from contact with said base or said riser.

29. The bow and arrow of claim 28 wherein said base includes means for adjusting the mounting position of said launcher relative to said riser, said resilient gripping means including an arrow shaft receiving channel dimensioned larger than the diameter of a shaft of said arrow, said resilient gripping means having a pair of inwardly tapering forwardly extending resilient fingers for gripping said arrow.

* * * * *